United States Patent [19]

Petukhov et al.

[11] 4,248,133

[45] Feb. 3, 1981

[54] IMPACT MECHANISM

[76] Inventors: Vadim D. Petukhov, ulitsa Kropotkina, 127, kv. 493; Viktor A. Gaun, ulitsa Gogolya, 21a, kv. 14; Oleg I. Bobrov, ulitsa Olgi Zhilinoi, 71, kv. 48, all of Novosibirsk, U.S.S.R.

[21] Appl. No.: 850,941

[22] Filed: Nov. 14, 1977

[51] Int. Cl.[3] ..... F01L 21/02; F01B 25/02

[52] U.S. Cl. ..... 91/20; 91/325; 91/234; 91/468; 251/DIG. 3

[58] Field of Search ..... 251/DIG. 3; 91/325, 91/234, 20, 24, 25, 12

[56] References Cited

U.S. PATENT DOCUMENTS

| | | | |
|---|---|---|---|
| 337,431 | 3/1886 | Pintsch | 251/DIG. 3 |
| 657,716 | 9/1900 | Waugh | 91/234 |
| 1,414,224 | 4/1922 | Smith | 91/325 |
| 3,160,071 | 12/1964 | Kandelman | 251/DIG. 3 |
| 3,896,834 | 7/1975 | Paul, Jr. | 251/DIG. 3 |

*Primary Examiner*—Paul E. Maslousky
*Attorney, Agent, or Firm*—Lackenbach, Lilling & Siegel

[57] ABSTRACT

An impact mechanism operated with gaseous fluid under pressure fed from a source of fluid having a casing with an inner cylindrical space. A piston is accommodated for reciprocation within the cylindrical space of the casing to divide the space into a work stroke chamber and an idle stroke chamber. The chambers are in communication with the source of gaseous fluid through a distribution means for reciprocation of the piston under the action of fluid. A valve is provided over the inlet port of at least one chamber to admit gaseous fluid under pressure thereto. The valve comprises biasing means in the form of a helical compression spring mounted coaxially with the inlet port of the chamber. One end of the spring is tightly sealed and the other end is fixed over the inlet port of the casing. Gaseous fluids under pressure is admitted to the chamber through gaps between the turns of the spring when the spring is expanded, and the admission is interrupted when the spring is compressed. There is also provided a working implement received in the casing and operated by the piston.

5 Claims, 7 Drawing Figures

IMPACT MECHANISM

BACKGROUND OF THE INVENTION

The invention relates to impact mechanisms, and more particularly to impact mechanisms operated with gaseous fluid under pressure, such as with compressed air or steam.

The present invention is preferably used in pneumatic impact mechanisms employed in the mining industry, such as deep-well pneumatic hammers, rock drills and pick hammers.

The invention may also be used in constructional equipment, for instance pneumatic pile drivers, air-operated moles for driving holes in soil and pavement breakers.

The invention may be used also for improving other types of impact mechanisms employed by engineering organizations, for instance in the construction of chipping and riveting hammers, tamping tools and the like.

At present, two types of impact mechanisms operated with gaseous fluid under pressure are known, namely those in which gaseous fluid is distributed into the chambers of the mechanism with or without the employment of a valve.

Known in the art is a valveless pneumatic impact mechanism comprising a hollow casing accommodating a reciprocating piston which divides the inner space of the casing into a work stroke chamber and an idle stroke chamber. There is a socket at one end of the casing for receiving a working implement, and at the other end, the casing is provided with a distribution chamber. The piston of the mechanism comprises a shank and a head, the shank facing the distribution chamber. For feeding gaseous fluid under pressure at regular intervals to the work stroke chamber and to the idle stroke chamber and for discharging exhaust gaseous fluid into atmosphere, the mechanism includes, means for distributing gaseous fluid comprising a counterbore of the casing in the zone of contact with the piston shank communicating with the distribution chamber; inner passage of the piston has one end opening to the idle stroke chamber and its other end opening to the periphery of the shank in the zone of contact thereof with the inner surface of the casing. There is also provided an outer passage on the piston shank disposed between the surface of the shank in contact with the casing and the piston head, and ports in the casing for discharging exhaust gaseous fluid.

When the distribution chamber of the casing is connected to a source of gaseous fluid under pressure, the fluid is admitted to the counterbore of the casing and proceeds therefrom, depending on the position of the piston relative to the casing, either to the idle stroke chamber, via the inner passage of the piston, or to the work stroke chamber, via the outer passage of the piston shank. Communication of the chambers of the mechanism with the source of gaseous fluid under pressure at regular intervals, via the above-mentioned passages, and with the atmosphere, via the ports of the casing, provides for reciprocations of the piston so that the piston delivers a blow to the working implement at the end of a work stroke.

The valveless pneumatic impact mechanism is characterized in that the beginning and the end of the admission of gaseous fluid to each chamber occurs at the same position of the piston relative to the casing. This results in a rapid deceleration of the piston during the idle stroke, lowers the pressure of gaseous fluid in the chambers of the mechanism and reduces impact energy and power.

Another known pneumatic impact mechanism includes a casing with the inner space accommodating a reciprocating piston dividing said inner space of the casing into a work stroke chamber and an idle stroke chamber. There is provided a socket at one end of the casing for receiving a working implement, and the other end of the casing is provided with a distribution unit including a distribution chamber and a valve box. The valve box accommodates a rigid plate valve mounted for limited reciprocations. When in the extreme position, the valve bears against one of annular projections provided on the opposite working surfaces of the distribution unit to define a valve aperture with the opposite annular projection. The annular projections and the valve divide the valve box into three portions: an outer portion, connected with the distribution chamber and two inner portions separated by the valve and one inner portion being connected with the work stroke chamber and the other inner portion being connected with the idle stroke chamber.

There are provided ports in the casing for discharging exhaust gaseous fluid from the chambers into the atmosphere.

When the distribution chamber of the distribution unit is connected to a source of gaseous fluid under pressure, the fluid is admitted, via the valve aperture, to the idle stroke chamber to enable or commence the idle stroke of the piston. The valve aperture defined by the annular projection and the valve on the opposite side of the valve is closed by the valve at this moment so that gaseous fluid is not admitted to the work stroke chamber. When the piston leaves open the ports of the casing connecting the idle stroke chamber with the atmosphere, the pressure of gaseous fluid in the chamber and at the valve surface located inwardly of the open valve aperture decreases. The pressure of gas at the opposite side of the valve mounted inside the closed valve aperture increases due to the compression of gas in the work stroke chamber. During further movement of the piston, the resultant force applied to the valve changes its direction to cause the displacement of the valve. The valve aperture, which connected the idle stroke chamber to the distribution chamber beforehand, is closed, and the opposite valve aperture provides for the admission to the work stroke chamber is opened. The work stroke chamber is filled with gaseous fluid under pressure. The piston is stopped and then performs the work stroke. At the end of the work stroke, the piston leaves open the port of the casing to connect the work stroke chamber with the atmosphere. The pressure of gaseous fluid in the work stroke chamber decreases, and the pressure of gas in the idle stroke chamber increases due to compression of the gas by the piston.

This causes the displacement of the valve to open the valve aperture controlling the admission of gaseous fluid to the idle stroke chamber and to close the opposite valve aperture. After a blow is imparted by the piston to the working implement, the above-described cycle is repeated.

The main disadvantage of the valve-type pneumatic impact mechanism resides in that a substantial pressure drop is required to displace the valve in the chamber which was filled through the valve prior to the displacement thereof. A delay in the displacement of the valve relative to the moment of the beginning of opening of the exhaust ports of the casing by the piston results in an increase in consumption of gaseous fluid under pressure. The live section of the valve apertures in such mechanism is relatively small thus resulting in reduced average pressure in the chamber and lower power. The attempts to increase the live section of the valve apertures result in significant increase in the consumption of gaseous fluid under pressure and unstable performance of the mechanism.

The attempts to reduce the consumption of gaseous fluid under pressure has resulted in the provision of valve-type pneumatic impact mechanisms in which a rocking plate valve is used. Such impact mechanism are provided with a valve having the form of an elongate rhombic mounted with the obtuse angle thereof to the working surface of the distribution unit and defining therewith apertures which are wedge-shaped at lateral sides. Two passages of the distribution unit open to the working surface thereof on either side of the line of contact of the valve and the distribution unit, one passage being connected to the work stroke chamber and the other passage, being connected to the idle stroke chamber. Upon rocking of the valve about the line of contact with the distribution unit, one passage of the working surface thereof is opened by the valve, and the other passage is concurrently closed by the valve, and vice versa.

The pneumatic impact mechanism with rocking valve functions in the same manner as that with the plate valve the above-described mechanism.

The main disadvantage of the pneumatic impact mechanisms incorporating a rocking valve resides in a small live section of the valve apertures which does not enable high average pressure in the chambers of the impact mechanism, lowers the impact energy and power.

It is also known to use, in pneumatic impact mechanisms, combined means for distributing gaseous fluid to admit the fluid to the chambers of the mechanism through the casing passages and piston passages when the latter are brought in register with the casing passages, and additionally to admit gaseous fluid to the chambers via a valve.

Also well known is a pneumatic impact mechanism including a casing accommodating a reciprocating piston having a head and a hammer rod, the piston dividing the inner space of the casing into a work stroke chamber and an idle stroke chamber. A socket is provided at one end of the casing to receive a working implement, and a valve-type distribution assembly is provided at the other end of the casing. The piston is mounted with the hammer rod thereof facing the working implement, and a groove is made in the periphery of the piston. The casing has radial passages and ports, the passages communicating with the distribution chamber and opening to the inner periphery of the casing, and the ports connecting the inner space of the casing with the atmosphere. The piston of the mechanism is provided with a central passage. The valve-type distribution assembly of the mechanism comprises a distribution unit and a valve made in the form of a cantilevered flexible plate which is mounted in a spaced relationship with ports of the distribution unit opening, at the opposite end, to the work stroke chamber. The valve space defined by the distribution unit, valve and casing is connected with the distribution chamber.

When the distribution chamber is connected to a source of gaseous fluid under pressure, the fluid is exhausted into the atmosphere, via the gap between the valve and distribution unit, the ports of the distribution unit, the work stroke chamber and the ports of the casing. Under the action of pressure difference of gaseous fluid between the valve space and the idle stroke chamber, the valve is deflected to close the ports of the distribution unit and to seal the work stroke chamber off from the distribution chamber. At the same time, fluid under pressure is admitted via the radial passages of the casing and groove of the hammer rod of the piston, to the idle stroke chamber to enable or commence the idle stroke of the piston.

When the hammer rod of the piston closes the radial passages of the casing, the admission of gaseous fluid under pressure to the idle stroke chamber is interrupted, and fluid is then discharged from this chamber upon opening of the casing ports by the piston head. During this time, the hammer rod of the piston opens the radial passages of the casing to admit gaseous fluid under pressure to the work stroke chamber, via the central passage of the piston. The pressure difference of gaseous fluid at the valve decreases, and the valve is straightened under the action of elastic forces to open the ports of the distribution unit so as to admit gaseous fluid from the distribution chamber to the work stroke chamber. The piston is stopped and then performs the work stroke.

During the work stroke of the piston, the work stroke chamber, at the initial period of piston movement is connected with a source of gaseous fluid under pressure via the valve and concurrently, via the radial passages of the casing.

When the hammer rod of the piston closes the radial passages of the casing, gaseous fluid under pressure is only admitted to the work stroke chamber through the valve. Further, the piston leaves open the casing ports, and the fluid is discharged from the work stroke chamber. The pressure in the work stroke chamber decreases, and the pressure difference acting on the valve increases. With a predetermined pressure difference value, the value is deflected to close the ports of the distribution unit. At this moment, the groove of the hammer rod of the piston is brought in register with the radial passages of the casing to provide for admission to the idle stroke chamber. After the delivery of a blow to the working implement, the piston performs the idle stroke.

The pneumatic impact mechanism having combined distribution means features a low specific consumption of gaseous fluid under pressure. The main disadvantage of this mechanism resides in a small live section of the valve and relatively large size of the distribution assembly hampering the incorporation of the mechanism in small-diameter casings.

It is known that power, consumption of gaseous fluid under pressure, simplicity, mass and size of the mechanism are the main factors influencing the performance and efficiency of impact mechanisms operated with gaseous fluid under pressure.

The level of quality of impact mechanisms mainly depends on design, function and consumption characteristics of means for distributing gaseous fluid under pressure to the chambers of the mechanism for enabling reciprocatory movement. Small live section of passages for admission of gaseous fluid to the chambers of the mechanism, complicated structure and large size are among the main disadvantages of the existing distribution means.

SUMMARY OF THE INVENTION

It is an object of the invention to eliminate the above-mentioned disadvantages.

It is also an object of the invention to reduce the specific consumption of gaseous fluid.

Still another object of the invention is to improve power capacity of the impact mechanism.

Another object of the invention is to simplify the construction of the impact mechanism.

Additionally, it is an object of the invention to reduce the weight and size of the impact mechanism.

The above objects are accomplished by an impact mechanism operated with gaseous fluid under pressure including a casing having an inner cylindrical space accommodating a reciprocating piston which divides the inner space of the casing into a work stroke chamber and an idle stroke chamber both communicating, via means for distributing gaseous fluid, to a source of gaseous fluid under pressure to enable reciprocation of the piston under the action thereof. The inlet port of at least one mentioned chamber having a valve providing for admission of gaseous fluid under pressure thereto, and there is provided a working implement received in the casing and driven by the piston. The valve comprises a helical compression spring mounted coaxially with the inlet port of the chamber having one extremity end which is sealed and the other extremity secured to the casing over the inlet port, gaseous fluid under pressure being admitted to the chamber through gaps between the turns of the spring when the spring is expanded, and the admission is interrupted when the spring is compressed.

It has been found that the valve which is so constructed features an excellent consumption characteristic. While there is a large amount of the aperture space between the spring turns which remains substantially unchanged during the period in which an intensive supply of gaseous fluid under pressure is to be delivered to the chamber of the mechanism, the spring is abruptly compressed until complete engagement of turns occurs when the flow rate of gaseous fluid through the apertures between the turns thereof exceeds a critical value.

Structural dimensions of the spring may be selected in such a manner that complete compression of the spring and interruption of the admission of gaseous fluid to the chamber occur up to the moment of the opening of the exhaust port of the casing by the piston or during the initial stage of the opening of this port by the piston.

The above-described properties of the valve made in the form of a compression spring enable an enlargement of the live section of the aperture between turns alongside with timely interruption of the admission of gaseous fluid to the chamber of the mechanism. This improves the output of the mechanism and reduces specific consumption of gaseous fluid under pressure.

The small size of the valve simplifies its incorporation and reduces the size and mass of the impact mechanism, while the provision of the admission aperture between the spring turns permits thorough machining of the casing surfaces co-operating with the valve to be dispensed with.

The helical compression spring is preferably cylindrical. This simplifies the manufacture and enlarge the field of application of the valve.

In certain impact mechanisms with low consumption of gaseous fluid under pressure, the compression spring is preferably barrel-shaped.

This form of the spring results in improved sealing of the apertures between the turns with the compressed spring and lowers leakages of gaseous fluid from the source thereof.

With the small size of the mechanism, a conical helical compression spring is preferably used.

This improves the strength and stability of the valve.

The free extremity of the helical spring is preferably tightly sealed by a cap. Thus, that part of the spring in which the turns most tightly engage one another upon compression of the spring with minimal axial force, may be used for admission of gaseous fluid to the chamber of the mechanism. This results in higher response speed of the valve and improved efficiency thereof.

In certain mechanisms, the free extremity of the spring is preferably tightly sealed by the end thereof wound into a spiral. This improves the strength of the valve.

The compression spring is preferably provided with a stroke limiter for limiting its expansion. This lowers high-frequency vibrations of the spring upon expansion and improves its durability.

The spring stroke limiter preferably comprises a projection of the casing located opposite to the free extremity of the spring. This simplifies the construction of the impact mechanism and improves its reliability.

With a large length of the helical compression spring, the cap is preferably made with an axial hole to pass therethrough a guide rod secured to the casing coaxially with the spring. The provision of the guide rod improves the stability of the spring movement, ensures favorable conditions for complete engagement of the turns upon compression of the spring and improves the reliability of the valve.

In certain impact mechanisms, the guide rod is preferably provided with an axial passage for admission of gaseous fluid under pressure to the chambers of the mechanism. This simplifies the construction of the impact mechanism and improves its reliability.

In case the springs are provided in both chambers, both springs may be mounted coaxially with each other, one extremity of each spring being secured to the casing and the other extremity being tightly sealed by a common cap having a through-passing hole for a guide rod secured to the casing. This facility provides a feedback between the movement of turns of both springs and improves the reliability of the impact mechanism.

Both springs are preferably mounted coaxially with and above each other with one extremity of each spring secured to the casing, the other extremities of the springs being tightly sealed by means of a common cap having on one side thereof a guide rod movably received in a hole of the casing in such a manner that the end of the rod is under the action of gaseous fluid under pressure. This facility enables a timely interruption of the admission of gaseous fluid under pressure to the chamber which is opened through the exhaust ports of the casing for a shorter time and improves the output of the impact mechanism.

BRIEF DESCRIPTION OF THE DRAWINGS

The invention will now be described with reference to specific embodiments thereof illustrated in the accompanying drawings, in which.

DESCRIPTION OF THE PREFERRED EMBODIMENT

Figure 1:
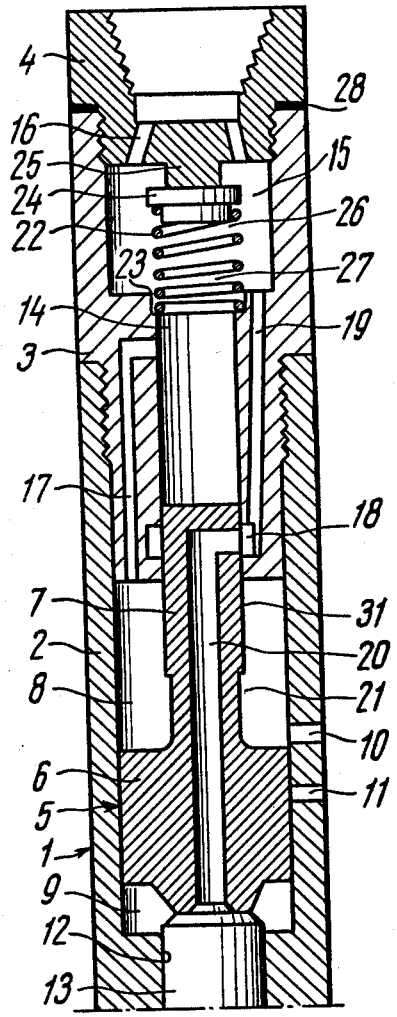
FIG. 1 is a longitudinal sectional view of the impact mechanism of the invention.

The impact mechanism shown in FIG. 1 is preferably used in pneumatic hammers having a small-diameter casing for lowering into wells.

A casing 1 as best shown in FIG. 1, which is made in the form of interconnected parts including a hollow cylinder 2, a gaseous fluid distribution unit 3 and a coupling 4 for connection to a source of gaseous fluid under pressure (not shown). The casing 1 is provided with an inner space accommodating a reciprocating piston 5 having a head 6 and a shank 7 which divides the inner space into a work stroke chamber 8 and an idle stroke chamber 9. The cylinder 2 is provided with exhaust ports 10, 11 for discharge of exhaust gaseous fluid from the above-mentioned chambers and is provided, at the free end thereof, with a socket 12 for receiving a working implement 13. The gaseous fluid distribution unit 3 has a central bore 14 defining an inlet port of the work stroke chamber 8 which flares on the side of the coupling 4 to define therewith a distribution chamber 15 communicating with the source of gaseous fluid under pressure through lateral openings 16 of the coupling 4. The wall of the distribution unit 3 has a lateral passage 17 opening to the work stroke chamber 8 on one side, and to the central bore 14, on the other side, adjacent to the termination of this bore in the distribution chamber 15. An annular groove 18 is provided on the inner periphery of the central bore 14 adjacent to the termination of the bore in the work stroke chamber 8, and said groove communicating with the distribution chamber 15 via a longitudinal passage 19. The piston 5 is received, with the shank 7 thereof, in the central bore 14 and has an axial passage 20 connecting the annular groove 18 to the idle stroke chamber 9. In order that the annular groove 18 could communicate with the work stroke chamber 8 when the piston 5 is at the greatest distance from the working implement 13, an outer passage 21 is made on the shank 7 of the piston 5.

A valve is provided in the distribution chamber 15, between the distribution unit 3 and the coupling 4, over the inlet port of the chamber 8, the valve being made in the form of a helical compression spring 22. One extremity of the spring 22 is rigidly fixed in a recess 23 of the distribution unit 3 surrounding the central bore 14, and the other extremity of the spring 22 is tightly sealed by means of a cap 24. The stroke of the spring 22 when expanded is limited by a projection 25 made on the coupling 4, the cap 24 bearing against the projection. An inlet aperture 26 of the valve 22 is defined by the gap between the turns of the spring 22 and has a helical shape. This provides for a larger length of the inlet apparatus 26 thus increasing the live section of the inlet aperture 26 with a small diameter of the valve. The distribution chamber 15 is connected with the inner space 27 of the spring 22 and further, via the central bore 14 and the lateral passage 17, with the work stroke chamber 8, via the inlet aperture 26. Gaskets 28 located between the coupling 4 and the gaseous fluid distribution unit 3 are provided for adjustment of live section of the inlet aperture 26 by adjusting the height of the spring 22 and the gap between the turns with the expanded spring 22.

Figure 2:
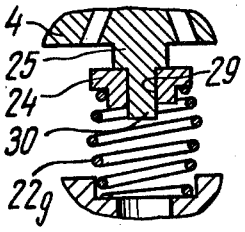
FIG. 2 is a fragmentary, cross-sectional view of one embodiment of a valve in the impact mechanism of the invention.

In order to provide for stable displacement of the spring 22 and simultaneous closure of the inlet aperture 26 with the turns thereof, the cap 24 (FIG. 2) is provided with a hole 29 receiving a guide rod 30 disposed on the projection 25 of the coupling 4. The compression spring 22*g* shown in this Figure is barrel-shaped thus improving the sealing of the inlet aperture with the compressed spring 22*g*.

Figure 3:
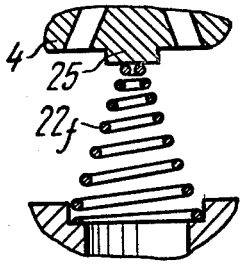
FIG. 3 is another fragmentary, cross-sectional view of an alternate embodiment of a valve in the impact mechanism of the invention.

Another embodiment of the valve is shown in FIG. 3, where the spring 22*f* is conical, and the free extremity of the spring is tightly sealed by the turns of the spring 22*f* wound into a spiral and the free extremity of said spring bears directly against the projection 25 of the coupling 4.

In operation, the impact mechanism is connected, via the coupling 4 (FIG. 1), to a source of gaseous fluid under pressure, and fluid is admitted, via the lateral openings 16, to the distribution chamber 15 and therefrom, via the longitudinal passage 19, and the annular groove 18, to the axial passage 20. The fluid is also fed, via the inlet aperture 26, to the inner space 27 of the spring 22, central bore 14, lateral passage 17, work stroke chamber 8 and exhaust port 10, into the atmosphere. Due to the fact that the inflow of gaseous fluid under pressure to the distribution chamber 15 during this period exceeds the flow rate of the fluid through the inlet aperture 26, a pressure difference appears between the distribution chamber 15 and the inner space 27 of the spring 22, and under the action of this pressure difference, the cap 24 is spaced apart from the projection 25 and displaced towards the fixed extremity of the spring 22. The spring 22 is compressed until the complete engagement of the turns thereof occurs, and admission of gaseous fluid under pressure to the work stroke chamber 8, via the spring 22, is interrupted. The gaseous fluid under pressure which had the time to be admitted to the work stroke chamber 8 through the inlet aperture 26 up to this moment, is discharged from this chamber through the exhaust port 10 into atmosphere. At that moment, the piston 5, under the pressure of the gaseous fluid in the axial passage 20 moves away from the working implement 13, and gaseous fluid under pressure is fed, via the axial passage 20, to the idle stroke chamber 9 to fill it. When the annular groove 18 is closed by the periphery 31 of the shank 7, the admission of gaseous fluid to the idle stroke chamber 9 is interrupted, and further, after the head 6 of the piston 5 opens the exhaust port 11, exhaust gaseous fluid is discharged into atmosphere from the idle stroke chamber 9. As the piston 5 continues its movement, the outer passage 21 of the shank 7 is brought in register with the annular groove 18, and gaseous fluid under pressure is admitted to the work stroke chamber 8 and therefrom, via the lateral passage 17 and central bore 14, to the inner space 27 of the spring 22. The pressure difference between the distribution chamber 15 and the inner space 27 begins to decrease. At a predetermined value of the above-mentioned pressure difference, the spring 22 starts expanding under the action of elastic forces. The turns of the spring 22 are spaced apart to open the inlet aperture 26 through which the gaseous fluid from the distribution chamber 15 is admitted to the inner space 27 of the spring 22 and further, via the central bore 14 and the lateral passage 17, to the work stroke chamber 8. The pressure in the chamber 8 rapidly increases to become equal to the pressure in the distribution chamber 15. The spring 22 is expanded until the cap 24 bears against the projection 25. Thus, the inlet aperture 26 is completely opened. The piston 5 is decelerated and stopped under the pressure of gaseous fluid in the work stroke chamber 8 and the central bore 14.

After the stoppage, the piston 5 starts moving towards the working implement 13. When the periphery 31 of the shank 7 closes the annular groove 18, the admission of gaseous fluid under pressure to the work stroke chamber 8 via the annular groove 18 is interrupted, and the chamber remains in communication with the distribution chamber 15 only through the spring 22. Due to a low resistance offered by the inlet aperture 26 to the flow of gaseous fluid, the pressure difference between the distribution chamber 15 and the inner space 27 during the admission of gaseous fluid to the work stroke chamber 8 is low and considerably lower than the total pressure difference between the source of gaseous fluid under pressure and the work stroke chamber 8. During this time, the inlet aperture 26 is substantially completely open to provide for high pressure in the work stroke chamber 8. At the moment when the head 6 of the piston 5 starts leaving the exhaust port 10 open, or slightly before that moment (depending on the parameters of the construction), the flow rate of gaseous fluid through the valve attains a critical value and a further, even minor decrease in the pressure in the chamber 8 during this time results in an abrupt increase in the pressure difference between the distribution chamber 15 and the inner space 27 of the spring 22. This is attributed to the fact that the inflow of gaseous fluid to the distribution chamber 15 begins exceeding the flow rate of the fluid through the inlet aperture 26. The pressure in the distribution chamber 15 becomes equal to the pressure of the source of fluid under pressure, and the pressure in the inner space 27 of the spring 22 becomes equal to the pressure of the fluid in the work stroke chamber 8. Under the action of the abruptly increased pressure difference of the gaseous fluid, the cap 24 is moved away from the projection 25 and displaced towards the fixed extremity of the spring 22. The spring 22 is compressed until complete engagement of the turns thereof occurs, and the admission of gaseous fluid under pressure to the work stroke chamber 8 is interrupted and ceases. Further, exhaust gaseous fluid is discharged from the chamber 8 into the atmosphere.

When the axial passage 20 is brought in register with the annular groove 18, gaseous fluid under pressure is admitted from the distribution chamber 15 to the idle stroke chamber 9 to fill it. The piston 5 delivers a blow to the working implement 13, and the idle stroke of the piston 5 begins. Then the above-described cycle of the piston movement is repeated.

Figure 4:
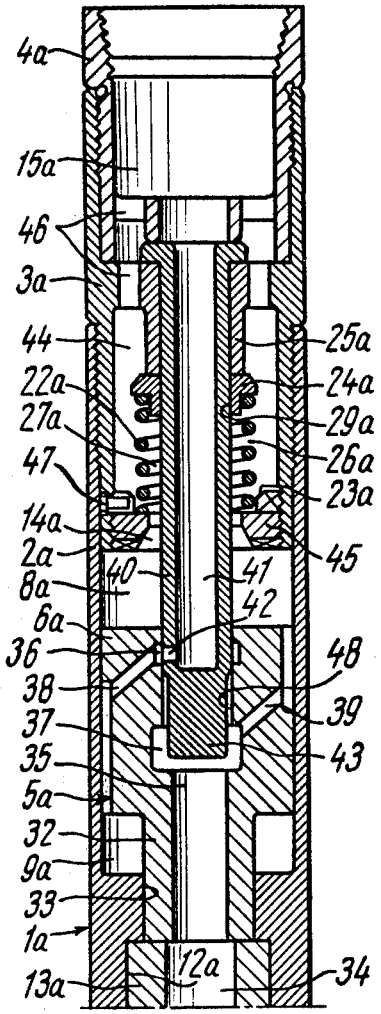
FIG. 4 is a longitudinal sectional view of the impact mechanism of the invention wherein a guide rod is provided with an axial passage for admission of gaseous fluid under pressure to the chambers of the mechanisms.

In deep-well pneumatic hammers with the discharge of exhaust gaseous fluid to the face of the well, the impact mechanism shown in FIG. 4 is preferably used which represents another embodiment of the invention.

In this alternate form of construction, the casing 1*a* includes a cylinder 2*a*, a gaseous fluid distribution unit 3*a* and a coupling 4*a* for connection to a source of gaseous fluid under pressure (not shown). The casing 1*a* is provided with an inner space accommodating a reciprocating piston 5*a* having a head 6*a* and a hammer rod 32 which divides the inner space into a work stroke chamber 8*a* and an idle stroke chamber 9*a*. At the free end of the cylinder 2*a*, there is provided a hole 33 for the hammer rod 32 of the piston 5*a* and a socket 12*a* for receiving a working implement 13*a* provided with an exhaust passage 34 for discharge of exhaust gaseous fluid from the above-mentioned chambers into surrounding space. The piston 5*a* has a bore 35 and annular passages 36,37 on the inner periphery thereof, the annular passage 36 is closer to the work stroke chamber 8*a* and communicates with the idle stroke chamber 9*a* through a passage 38 of the piston 5*a*, whereas the other annular passage 37 communicates with the work stroke chamber 8*a* via a passage 39. The gaseous fluid distribution unit 3*a* has a central bore 14*a* receiving a central guide and a distribution rod 40 passing therethrough with a space therebetween, the rod being fixed to the gaseous fluid distribution unit 3*a* by means of the coupling 4*a*. The distribution rod 40 is received in the bore of the piston 5*a* and has an axial passage 41 and a radial port 42 for admission of gaseous fluid under pressure from the distribution chamber 15*a* made in the coupling 4*a* to the annular passages 36 and 37 of the piston 5*a* when they are brought in register with the radial port 42 of the distribution rod 40, as well as a shut-off rod 43 for closing the bore 35 of the piston 5*a*.

The central bore 14*a* which is the inlet port of the work stroke chamber 8*a* flares in the medium portion thereof to define a chamber 44 accommodating a valve in the form of a helical compression spring 22*a* mounted over the central bore 14*a*. One extremity of the spring 22*a* is fixedly secured in a recess 23*a* made in the inner end wall of an annular partition 45 of the gaseous fluid distribution unit 3*a* around the central bore 14*a*, and the other extremity of the spring 22*a* is tightly sealed by means of a cap 24*a* having an axial bore 29*a* receiving the guide and distribution rod 40. The stroke of the spring 22*a* when expanded is limited by a projection 25*a* provided on the gaseous fluid distribution unit 3*a* opposite to the free extremity of the spring 22*a*. The chamber 44 in which the spring 22*a* is located communicates, on one side, via an inlet aperture 26*a* defined by the gap between the turns of the spring, 22*a* inner space 27*a* of the spring 22*a* and central bore 14*a*, with the work stroke chamber 8*a*, and on the other side, with the distribution chamber 15*a*, via lateral openings 46 of the distribution unit 3*a* and coupling 4*a*.

For adjustment of the live section of the inlet aperture 26*a* of the valve spring 22*a*, the annular partition 45 to which one extremity of the spring 22*a* is secured, is connected to the distribution unit 3*a* by means of a threaded joint and is provided with a lock 47.

In operation the impact mechanism is connected through the coupling 4*a* to a source of gaseous fluid under pressure, and fluid is admitted to the distribution chamber 15*a* and therefrom it is fed, via the lateral openings 46, chamber 44, inlet aperture 26*a*, inner space 27*a* of the spring 22*a*, central bore 14*a*, work stroke chamber 8*a*, passage 39 and bore 35 of the piston 5*a*, and the exhaust passage 34 of the working implement 13*a* into the surrounding space. The fluid is also fed to the idle stroke chamber 9*a*, via the axial passage 41, radial port 42, annular passage 36, and the passage 38. Since the inflow of gaseous fluid to the chamber 44 exceeds the flow rate thereof through the inlet aperture 26*a*, a pressure difference develops between the chamber 44 and the inner space 27*a* of the spring 22*a*, and the cap 24*a* is moved away from the projection 25*a* under the action of this pressure difference and is displaced towards the fixed extremity of the spring 22*a*. The spring 22*a* is compressed until complete engagement of the turns thereof occurs, and the admission of gaseous fluid under pressure to the work stroke chamber 8*a* is interrupted. The gaseous fluid under pressure which had the time to be admitted to the work stroke chamber 8*a* through the inlet aperture 26*a* by that moment, is discharged from this chamber 8*a* into the surrounding space. By that time, the piston 5*a* is moved away from the working implement 13*a* under the pressure of the gaseous fluid in the idle stroke chamber 9*a* to perform the idle stroke. When the radial port 42 is closed by the periphery 48 of the bore of the piston 5*a*, the admission of gaseous fluid under pressure to the idle stroke chamber 9*a* is interrupted, and, after the hammer rod 32 of the piston 5*a* leaves the hole 33 open, the fluid is discharged from this chamber. By that time, the shut-off rod 43 is within the bore 35 to seal the work stroke chamber 8*a* off from the surrounding space. As the piston 5*a* continues to move, the annular passage 37 is brought in register with the radial port 42, and the fluid under pressure is admitted, via this port and the passage 39, to the work stroke chamber 8*a* and therefrom, via the central bore 14*a* , to the inner space 27*a* of the spring 22*a*. The pressure difference between the chamber 44 and the inner space 27*a* of the spring 22*a* starts decreasing. At a predetermined value of the pressure difference, the spring 22*a* starts expanding under the action of inherent elastic forces to open the inlet aperture 26*a*. The pressure in the work stroke chamber 8*a* rapidly grows and becomes equal to the pressure in the distribution chamber 15*a*. The inlet aperture 26*a* completely opens. The piston 5*a* is decelerated and stopped. Then the piston 5*a* starts moving towards the working implement 13*a*. When the radial port 42 is closed by the periphery 48 of the bore of the piston 5*a*, the work stroke chamber 8*a* only communicates with the distribution chamber 15*a* through the valve spring 22*a*. Until the shut-off rod 43 leaves the bore 35 of the piston 5*a* open, the inlet aperture 26*a* is substantially completely open and provides for high pressure in the work stroke chamber 8*a*. When the shut-off rod 43 leaves the bore 35 of the piston 5*a* open, the flow rate of gaseous fluid under pressure through the valve spring 22*a* attains a critical value and a further, even minor displacement of the piston 5*a* results in an abrupt increase in the pressure difference between the chamber 44 and inner space 27*a* of the valve spring 22*a*, and the cap 24*a* is moved away from the projection 25*a* under the action of this pressure difference and is displaced towards the fixed extremity of the valve spring 22*a*. The inlet aperture 26*a* is closed, and the admission of gaseous fluid under pressure to the work stroke chamber 8*a* is interrupted so that exhaust gaseous fluid is further discharged from this chamber (8*a*) into the surrounding space, via the passage 39, bore 35 and the exhaust port 34. The hammer rod 32 of the piston 5*a* is, at that moment, within the bore 33, and the annular passage 36 is brought in register with the radial port 42. Gaseous fluid under pressure from the distribution chamber 15*a* is admitted to the idle stroke chamber 9*a* to fill it. The piston 5*a* delivers a blow to the working implement 13*a*, and the idle stroke of the piston 5*a* begins. The above-described cycle of movement of the piston 5*a* is then repeated.

Figure 5:
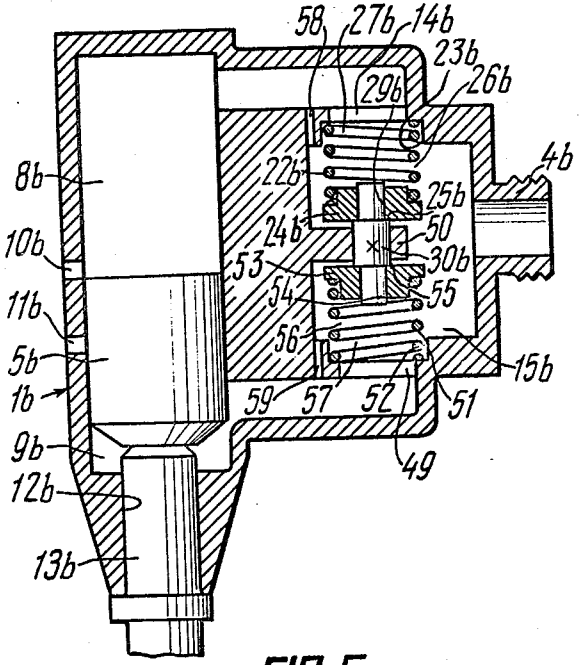
FIG. 5 is a longitudinal sectional view of the impact mechanism of the invention in which each chamber is provided with an individual valve comprising a helical compression spring.

In pneumatic impact mechanisms with elevated impact energy and limited consumption of gaseous fluid, the construction shown in FIG. 5 is preferably used which is another alternate embodiment of the invention.

The inner space of a casing 1*b* (FIG. 5) has exhaust ports 10*b*, 11*b* and accommodates a piston 5*b* dividing the inner space into a work stroke chamber 8*b* and an idle stroke chamber 9*b*. The casing 1*b* has, on the side of the idle stroke chamber 9*b*, a socket 12*b* for receiving a working implement 13*b*. A distribution chamber 15*b* is located adjacent to the inner space of the casing 1*b*, and the casing 1*b* is externally provided with a coupling 4*b* for connecting the distribution chamber 15*b* to a source of gaseous fluid under pressure (not shown). The upper part of the distribution chamber 15*b* communicates through a bore 14*b* with the work stroke chamber 8*b*, and the lower part of this chamber (8*b*) communicates with the idle stroke chamber 9*b* through a bore 49. The distribution chamber 15*b* of the casing 1*b* has a bracket 50 supporting a guide rod 30*b* which is provided with an enlargement in the intermediate part thereof, and there are provided two valves, one of which comprises a helical compression spring 22*b* and the other comprises a spring 51. The spring 22*b* has one extremity fixedly secured in a recess 23*b* of the casing 1*b* surrounding the bore 14*b* which is the inlet port of the work stroke chamber 8*b*, and the other extremity of the spring 22*b* is tightly sealed by means of a cap 24*b* having an axial hole 29*b* receiving the upper end of the guide rod 30*b*. With the expanded spring 22*b*, the cap 24*b* bears against a projection 25*b* of the guide rod 30*b*. The distribution chamber communicates with the inner space 27*b* of the spring 22*b* through an inlet aperture 26*b* between the turns of the spring, and further, with the work stroke chamber 8*b* through the bore 14*b*. The second spring 51 has one extremity fixedly secured in a recess 52 of the casing 1*b* surrounding the bore 49 which is the inlet port of the idle stroke chamber 9*b*, and the other extremity of the spring 51 is tightly sealed by means of a cap 53 having an axial hole 54 receiving the lower end of the guide rod 30*b*. With the expanded spring 51, the cap 53 bears against a projection 55 of the guide rod 31*b* on the lower side thereof. The distribution chamber 15*b* communicates with the inner space 57 of the spring 51 through an inlet aperture 56 between the spring turns, and further, with the idle stroke chamber 9*b* through the bore 49. The casing 1*b* has also two calibrated passages 58, 59 one of which connects the distribution chamber 15*b* to the work stroke chamber 8*b* and the other passage connects said chamber 15*b* with the idle stroke chamber 9*b*.

In operation, the impact mechanism is connected to the source of gaseous fluid under pressure through the coupling 4*b*, and fluid is admitted to the distribution chamber 15*b* and therefrom is fed, via the inlet aperture 26*b*, inner space 27*b* of the spring 22*b*, bore 14*b*, work stroke chamber 8*b* and exhaust port 10*b*, into the atmosphere. The fluid is also fed via the inlet aperture 56 of the other spring 51 and inner space 57 thereof, and the bore 49, to the idle stroke chamber 9*b*. Under the action of the pressure difference developed between the distribution chamber 15*b* and the inner space 27*b* of the spring 22*b*, the cap 24*b* is moved towards the fixed extremity of the spring 22*b*. The spring 22*b* is compressed until the turns thereof completely engage one another, and admission of gaseous fluid under pressure to the work stroke chamber 8*b* through the valve 22*b* is interrupted. The gaseous fluid which had time to be admitted to the work stroke chamber 8*b* through the inlet aperture 26*b* is discharged therefrom through the exhaust port 10*b* into the atmosphere. At that moment, under the pressure of gaseous fluid in the idle stroke chamber 9*b*, the piston 5*b* is moved away from the working implement 13*b* to perform the idle stroke. When the lower end of the piston 5*b* leaves the port 11*b* open, gaseous fluid flow rate through the inlet aperture 56 attains a critical value, and the pressure difference between the distribution chamber 15*b* and the inner space 57 of the spring 51 abruptly increases upon a further travel of the piston. The cap 53 is moved towards the fixed extremity of the spring 51 under the action of the pressure difference. The spring 51 is compressed until complete engagement of the turns thereof occurs, and the admission of gaseous fluid to the chamber 9*b* is interrupted. Further, the exhaust gaseous fluid is discharged into the atmosphere from the idle stroke chamber 9*b* through the exhaust port 11*b*. By that time, the pressure of gaseous fluid in the work stroke chamber 8*b* increases due to the admission of fluid from the distribution chamber 15*b* through the calibrated passage 58 and compression by the piston 5*b*, and the pressure difference between the distribution chamber 15*b* and the inner space 27*b* of the spring 22*b* decreases. With a predetermined value of the pressure difference, the spring 22*b* starts expanding under the action of its inherent resilience. The turns of the spring 22*b* disengage from one another to open the inlet aperture 26*b*, and the gaseous fluid starts flowing therethrough from the distribution chamber 15*b* into the work stroke chamber 8*b*. The pressure in the chamber 8*b* rapidly increases and becomes equal to the pressure in the distribution chamber 15*b*. Thus, the inlet aperture 26*b* completely opens, and the cap 24*b* bears against the projection 25*b*. The piston 5*b* is rapidly decelerated and stopped. Further, the piston 5*b* starts moving towards the working implement 13*b*. Due to the large live section of the inlet aperture 26*b*, high average pressure in the work stroke chamber 8*b* is ensured.

At the beginning of the opening of the exhaust port 10*b* by the piston 5*b*, the flow rate of gaseous fluid through the inlet aperture 26*b* attains its critical value, and the pressure difference between the distribution chamber 15*b* and the inner space 27*b* of the spring 22*b* abruptly increases with further travel of the piston. The cap 24*b* is moved towards the fixed extremity of the spring 22*b* to compress it until the turns are completely engaged. The admission of gaseous fluid under pressure through the valve to the work stroke chamber 8*b* is interrupted, and further the exhaust gaseous fluid is discharged from this chamber (8*b*) through the exhaust port 10*b* into the atmosphere.

By that time, the pressure of gaseous fluid in the idle stroke chamber 9*b* increases due to the admission of fluid thereto through the calibrated passage 59 and compression of fluid by the piston 5*b*, and the pressure difference between the distribution chamber 15*b* and the inner space 57 of the spring 51 decreases. With a predetermined value of the pressure difference the spring 51 is expanded to open the inlet aperture 56. The pressure in the chamber 9*a* rapidly increases and becomes equal to the pressure in the distribution chamber 15*b*. The inlet aperture 56 is thus completely opened, and the cap 53 bears against the projection 55. The piston 5*b* delivers a blow to the working implement 13*b*, and the idle stroke of the piston 5*b* begins. The above-described cycle of movement of the piston 5*b* is then repeated.

Figure 6:
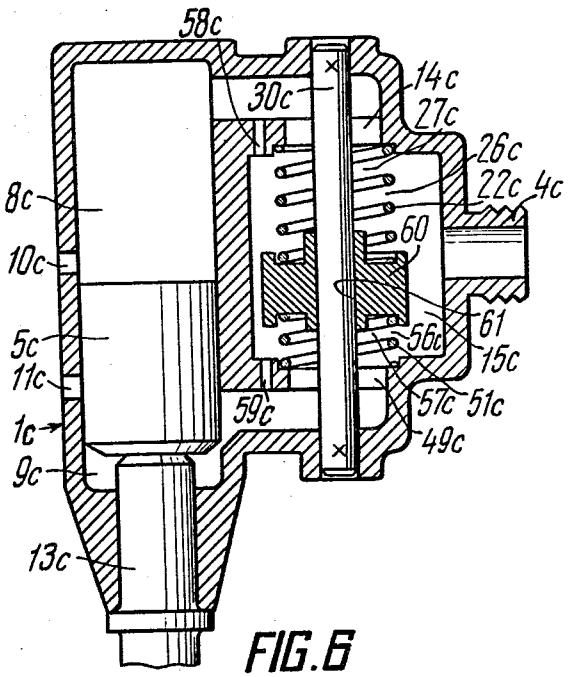
FIG. 6 is a longitudinal sectional view of the impact mechanism of the invention, in which one extremity of each spring is secured to the casing and the other extremities are tightly sealed by means of a common cap.

In pneumatic impact mechanism operating at high rate of blows, the construction shown in FIG. 6 is preferably used.

As different from the mechanism shown in FIG. 5, the mechanism shown in FIG. 6 has the free extremities of both springs 22*c*, 51*c* which are both tightly sealed by means of a common cap 60 having an axial hole 61 receiving a smooth guide rod 30*c* fixed to a casing 1*c*.

In operation, the impact mechanism is connected through a coupling 4*c* (FIG. 6) to a source of gaseous fluid under pressure (not shown), and fluid is admitted to a distribution chamber 15*c* and therefrom is fed, via an inlet aperture 26*c*, inner space 27*c* of the spring 22*c*, a bore 14*c*, work stroke chamber 8*c* and exhaust port 10*c*, into the atmosphere. The fluid is also fed via an inlet aperture 56*c* of the other spring 51*c*, inner space 57*c* of the spring 51*c* and a bore 49*c*, into an idle stroke chamber 9*c*. Since the pressure of gaseous fluid in the inner space 57*c* of the spring 51*c* supplying the idle stroke chamber 9*c* with fluid is higher than the pressure of gaseous fluid in the inner space 27*c* of the spring 22*c*, the common cap 60 is displaced to compress the spring 22*c* until complete engagement of its turns occurs. The admission of gaseous fluid to the work stroke chamber 8*c* is interrupted, and the fluid which had the time to be admitted to this chamber 8*c* is discharged therefrom through the exhaust port 10*c* into the atmosphere. After the displacement of the common cap 60, the live section of the inlet aperture 56*c* is enlarged. Under the action of pressure difference of fluid admitted to the idle stroke chamber 9*c*, the piston 5*c* is moved away from a working implement 13*c* to perform the idle stroke. During the displacement of the piston 5*c*, the pressure in the work stroke chamber 8*c* and in the inner space 27*c* of the spring 22*c* increases due to the admission of gaseous fluid through a calibrated passage 58*c* and compression of the fluid by the piston 5*c*. When the piston 5*c* leaves the exhaust port 11*c* open, the pressure of gaseous fluid in the idle stroke chamber 9*c* and in the inner space 57*c* of the spring 51*c* abruptly decreases. Under the action of the pressure difference of the gaseous fluid in the inner spaces of the springs 22*c* and 51*c*, the common cap 60 is moved downwards to compress the spring 51*c* until complete engagement of the turns thereof occurs, and the turns of the spring 22*c* disengage from one another to open the inlet aperture 26*c*. The admission of gaseous fluid to the idle stroke chamber 9*c* is interrupted, and further the exhaust gaseous fluid is discharged therefrom through the exhaust port 11*c* into atmosphere. The pressure in the work stroke chamber 8*c* rapidly increases to become equal to the pressure in the distribution chamber 15*c*. The piston 5*c* is decelerated and stopped. Further, the piston 5*c* starts moving towards the working implement 13*c*. When the piston 5c approaches the working implement 13c, the pressure in the idle stroke chamber 9c and in the inner space 57c of the spring 51c increases due to the admission of gaseous fluid through the calibrated passage 59c and compression of the fluid by the piston 5c. When the piston 5c leaves the exhaust port 10c open, the pressure of gaseous fluid in the work stroke chamber 8c and in the inner space 27c of the spring 22c abruptly decreases. Under the action of the pressure difference acting on the common cap 60 on either side, the cap is displaced towards the spring 22c to compress the spring 22c until complete engagement of the turns thereof occurs. The admission of gaseous fluid to the work stroke chamber 8c through the valve 22c is interrupted, and further the exhaust gaseous fluid is discharged into the atmosphere. Concurrently with the displacement of the common cap 60 towards the spring 22c, the turns of the spring 51c disengage from one another to open the inlet aperture 56c. The pressure in the idle stroke chamber 9c increases to become equal to the pressure in the distribution chamber 15c.

The piston 5c delivers a blow to the working implement 13c, and the idle stroke of the piston 5c begins. The above-described cycle of movement of the piston is repeated.

Figure 7:
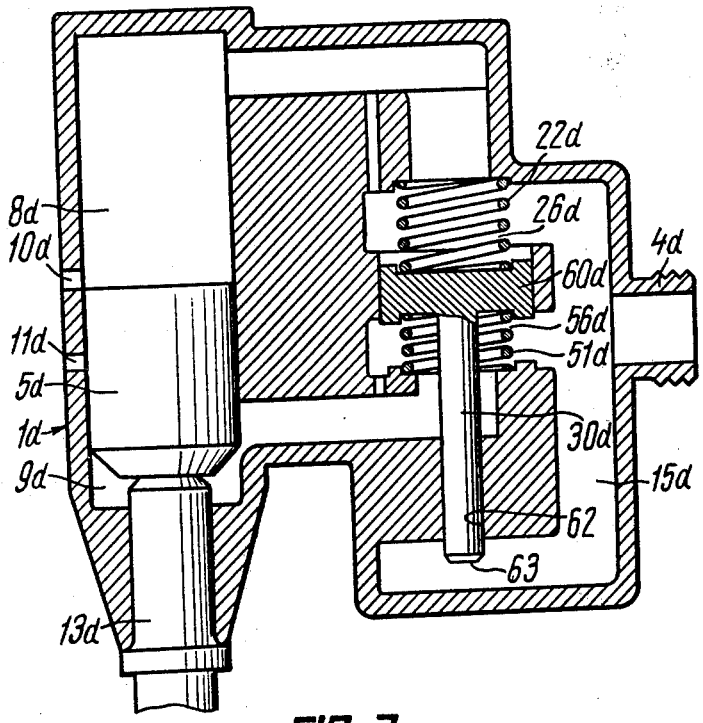
FIG. 7 is a longitudinal sectional view of the impact mechanism of the invention, in which the common cap sealing the extremities of the springs is provided on one side thereof with a guide rod.

In pneumatic impact mechanisms having a lightweight piston which recoils after the delivery of a blow to the working implement at a high speed, and for a more complete removal of exhaust gaseous fluid from the work stroke chamber, the construction shown in FIG. 7 is preferably used. In this impact mechanism, as differed from that shown in FIG. 6, a guide rod 30d is rigidly secured to a common cap 60d and is movable in a coaxial bore 62 of a casing 1d. The free end 63 of the guide rod 30d is received in a distribution chamber 15d and permanently subjected to the action of gaseous fluid under pressure.

In operation, the impact mechanism is connected to a source of gaseous fluid under pressure (not shown) through a coupling 4d, the fluid is admitted to the distribution chamber 15d and is fed therefrom, via an inlet aperture 26d, work stroke chamber 8d and exhaust port 10d, into the atmosphere. The fluid is also fed via an inlet aperture 56d, to an idle stroke chamber 9d. Under the action of pressure difference acting on the common cap 60d and on the guide rod 30d they are displaced upwards to compress a spring 22d. The inlet aperture 26d is thus closed, and the live section of the inlet aperture 56d of the spring 51d increases. A piston 5d performs the idle stroke. When the piston 5d leaves an exhaust port 11d open, the resultant force acting on the common cap 60d and guide rod 30d changes its direction, and they are displaced downwardly.

Thus, the inlet aperture 56d is closed, and the inlet aperture 26d is opened. Fluid is discharged from the idle stroke chamber 9d, and the work stroke chamber 8d is filled with gaseous fluid. The piston 5d is stopped and then moves towards the working implement 13d.

When the piston 5d leaves the exhaust port 10d open, the resultant force acting on the common cap 60d and the guide rod 30d changes its direction, and they are displaced upwardly. The inlet aperture 26d is thus closed, and the inlet aperture 56d is opened. Fluid is discharged from the work stroke chamber 8d, and the idle stroke chamber 9d is filled with gaseous fluid. The piston 5d delivers a blow to the working implement 13d and then performs the idle stroke.

The above-described cycle of movement of the piston 5d is then repeated.

While the invention has been described, disclosed, illustrated and shown in terms of an embodiment or modification which it has assumed in practice, the scope of the invention should not be deemed to be limited by the precise embodiment or modification herein described, disclosed, illustrated or shown, such other embodiments or modifications as may be suggested to those having the benefit of the teachings herein being intended to be reserved especially as they fall within the scope and breadth of the claims here appended.

What is claimed is:

1. An elongated impact mechanism of the type operated with gaseous fluid under pressure fed from a source of gaseous fluid comprising: a casing having an inner cylindrical space including a distribution zone; a piston including internal passage means accommodated in said cylindrical space for reciprocation, said piston dividing said space into a work stroke chamber and an idle stroke chamber; gaseous fluid distribution means in said casing and cooperating with said internal passage means for connecting said chambers to said source of gaseous fluid for ensuring reciprocations of said piston under the action of said fluid; a resilient valve comprising spring means having internal and external sides, said spring means being coaxial with said piston and being actuated solely by gaseous fluid externally and internally of said valve acting on said sides, and said valve being provided in said distribution zone over an inlet port of one of said chambers for admitting gaseous fluid under pressure to said work stroke chamber, the valve comprising compression spring means mounted coaxially with said inlet port of said work stroke chamber and having one free extremity and the other extremity which is retained in place in a recess of said fluid distribution means over said inlet port, gaseous fluid under pressure being admitted to said work stroke chamber through gaps between the turns of said spring means when said spring means is expanded, and the admission of said fluid is interrupted when the spring means is compressed, and the turns of said spring means are juxtaposed each other closing the gaps between the turns of said spring means, and a working implement adapted to be received in said casing and operated by said piston.

2. An impact mechanism according to claim 1, wherein said spring has a cylindrical shape.

3. An impact mechanism according to claim 1, wherein said spring means has a cap which is mounted at the free extremity of said spring means and is tightly sealed thereto.

4. An impact mechanism according to claim 1, wherein there is provided a stop limiting the stroke of said spring means secured to the casing.

5. An impact mechanism according to claim 4, wherein said stop limiting the stroke of the spring means comprises a projection of said casing located opposite to the free extremity of spring means.

* * * * *